US005685021A

United States Patent [19]

Tsujino

[11] Patent Number: 5,685,021

[45] Date of Patent: Nov. 11, 1997

[54] PROTECTIVE HEADGEAR FOR WRESTLER

[75] Inventor: Kanzo Tsujino, Orange, Calif.

[73] Assignee: ASICS Corporation, Kobe, Japan

[21] Appl. No.: 655,906

[22] Filed: May 31, 1996

[51] Int. Cl.[6] ..... A61F 11/14

[52] U.S. Cl. ..... 2/425; 2/209; 2/413

[58] Field of Search ..... 2/209, 412, 413, 2/414, 423, 425, 455; 128/864, 866, 867, 868

[56] References Cited

U.S. PATENT DOCUMENTS

| | | | |
|---|---|---|---|
| 2,898,596 | 8/1959 | Keen | 2/425 |
| 3,513,482 | 5/1970 | Holden | 2/425 |
| 5,138,722 | 8/1992 | Urella et al. | 2/413 |

*Primary Examiner*—Diana Biefeld
*Attorney, Agent, or Firm*—Michael E. Zall

[57] ABSTRACT

A protective wrestling headgear is provided having a pair of ear guards. Each ear guard has a generally disk-like core having a peripheral edge portion, an interior surface and an exterior surface. Preferably, a pattern of a plurality vent openings is provided in the core and connect the interior and exterior surfaces. A layer of gel cushioning material, preferably silicon gel cushioning material covers the interior surface of the peripheral edge. Preferably, a one-piece removable ear guard covering of a flexible material covers each ear guard. The covering has a core portion of a continuous web that covers the exterior surface of the core, leaving the pattern of vent openings exposed. The covering also includes a peripheral edge portion that covers the exterior surface of the peripheral edge and the layer of gel cushioning material. The flexible covering surrounding the peripheral edge has a tacky exterior surface to grip the area surrounding the wrestlers ear. A plurality of circumferentially spaced loops are associated with the peripheral edge portion of each ear guard. Each head strap has one end secured to a loop on one ear guard and the other end adjustably secured to a corresponding loop on the other ear guard by releasable engageable hook and pile retainers on the head strap. Some of the straps may have both ends adjustably secured to corresponding loops by such hook and pile retainers.

3 Claims, 5 Drawing Sheets

PROTECTIVE HEADGEAR FOR WRESTLER

BACKGROUND OF THE INVENTION

1. Field of The Invention

This invention relates to protective headgear used by wrestlers and the like, particularly adopted to protect against injuries to the ears.

2. Prior Art

Protective head gear, i.e., wrestling helmets, of the type to which this invention pertains are well known in the art. Most athletic sanctioning bodies require the use of such headgear in order to compete. Typically such headgear includes a pair of ear covering, cup-like guards secured to the wearer's head by means of straps that extend over the top of the head, around the rear of the head, and under the chin. The guards, which cover and protect the wearer's ears, contain a pad which is necessary for the wearer's comfort and protection. The ear pads are shaped in a generally triangular form to provide an ear receiving pocket which extends around the outside of the ear and against the wearer's head.

Examples of this type of headgear are described in the following references:

U.S. Pat. Nos. 2,277,994 and 2,886,818 to Roberts describes an ear guard for athletic headgear that includes a cup having a marginal flange and a U-shaped rubber member enclosing the marginal flange attached by rivets. The two ear guards are held in place by a suitable number of properly arranged head and chin bands which are attached to each other and the marginal flange by rivets. The headgear includes bands that are adjustable.

U.S. Pat. No. 2,898,596 to Keen describes ear protecting headgear having a pair of ear guards each having a substantially rigid inner shell and peripheral flanges. Each ear guard is covered by a shock absorbing material covering the entire outer surface and inner surfaces of the flanges. A plurality of adjustable non-elastic head straps connect the ear guards.

U.S. Pat. No. 3,311,921 to Helm describes wrestling headgear, similar to the aforementioned Roberts references, but having additional ventilation covered by a protective gridwork to prevent the insertion of a finger there through.

U.S. Pat. No. 3,327,316 to Pukish, Jr. describes a padded ear piece for use in wrestling headgear that prevents the rapid change of air pressure adjacent the wearer's ear opening. The head straps are formed of elastic material and are affixed to the padded ear pieces. One of the chin straps is connected to the ear piece by means of a releasable coupler such as a snap fastener, buckle or Velcro fastener.

U.S. Pat. No. 3,513,482 to Holden describes various wrestling headgear that include an ear covering having a peripheral flange comprised of a rubbery material. The inner shells of the ear guards are of rigid construction, typically of molded plastic, aluminum, spun glass or polyethylene. Additionally, a plurality of Velcro straps and a snap fasten chin strap are used to retain the headgear on the wrestler.

U.S. Pat. No. 3,541,611 to Beguin describes hearing protector ear cups supported by a lightweight head harness formed of flexible, substantially non-elastic straps. Attachment of the hearing protection cups to the head harness is effected by looping depending straps through a slotted rigid ear cup mounting ring within which the ear cup is pivotally mounted.

U.S. Pat. No. 3,594,815 to Reese describes a wrestler's helmet made from a continuous piece of knitted fabric which is elastic in mutual perpendicular directions.

U.S. Pat. No. 3,778,844 to Hori et al describes a configuration around the ears of a motorcycle helmet to prevent whistling.

U.S. Pat. No. 4,023,213 to Rovani describes a shock absorbing system for a football helmet comprising a web of a plurality of air filled compartments.

U.S. Pat. No. 4,287,613 to Schulze describes a helmet having an energy absorbing and sizing means mounted on the inside surface of the shell.

U.S. Pat. No. 4,516,274 to Buckland describes an adjustable ear cup retention harness adapted for use within rigid helmet shells. The helmet includes downwardly extending, inwardly concave sides which extend over and cover the ears of the wearer. The ear cups are provided with yieldable pads around the periphery of the parts of the ear cup intended to touch the wearer's head.

U.S. Pat. No. 4,551,861 to Marchello describes an ear pad for fastening within the ear protective guard of a helmet. The ear pad is formed of a thick, resilient, rubber-like sheet material that is molded with a central ear receiving pocket surrounded by bulged, cushion-forming strips which engage the wearer's head around the ear.

U.S. Pat. No. 4,612,672 to Shrack describes a protective headgear designed for use in water sports. The headgear has a ring-shaped member adapted to surround a wearer's head in combination with a cross-member extending from opposite edges of the ring shaped member. A pair of ear flaps extend downwardly from opposite edges of the ring shaped member. The device also has a sun visor and an adjustable chin strap.

U.S. Pat. No. 4,710,985 to Dubner, et al describes a protective headgear designed to protect the ears of wrestlers. The headgear includes a pair of ear guards having a shock absorbing inner foam surface with a substantially triangular ridge adapted to engage the head surrounding the ear. An outer vinyl covers the ear guard and an intermediate foam is bonded to the outer vinyl and inner foam surface. Top and rear head straps are included to attach the gear to the wearer's head by Velcro means and a chin strap is used to connect the lower portions of the guard to engage the wearer's chin.

U.S. Pat. No. 4,853,980 to Zarotti describes a padding element for a crash helmet.

U.S. Pat. No. 4,862,563 to Flynn describes a flexible securing strap having Velcro material at the ends.

U.S. Pat. No. 5,228,143 to Marchello describes an ear guard assembly with a removable pad.

U.S. Pat. No. 5,361,420 to Dobbs et al describes a protective headgear for wrestlers formed of nylon netting material that covers substantially the entire scalp.

Applicant is aware of the Brute MAXX ear guard that is a one-piece fabric ear guard have a front, rear strap and chin strap having Velcro closures.

All of the above prior art protective headgear suffer from certain problems. Foremost among these problems is that the headgear is either uncomfortable and/or provides insufficient protection to the wrestler. Another serious shortcoming of prior art devices is that such headgear is designed to be worn by many individuals, each having a different size and shape head. In use, the protective headgear is subjected to various pulls, tugs, pushes and shears. It thus becomes very difficult to have a single design of protective headgear that can remain substantially immobile on such a broad spectrum of people. Some prior art devices attempted to correct this problem through the use of a multiplicity of head straps. This, however, creates the additional problem of providing adjustable straps which are easy to use and do not render the already uncomfortable headgear even more so.

Cushioning elements filled with a gel cushioning material are well known in the art for use in shoes. For example, U.S. Pat. No. 4,768,295 to Ito describes a gel cushioning member for a shoe formed so as to have a plurality of chambers. When the cushioning member is placed in the recess formed in the sole plate, the filled chambers contact the bottom thereof and air chambers are formed between the filled chambers and the bottom of the recess. The air in the air chambers is compressed as the sole plate and the cushioning members are deformed by shock upon landing. See also U.S. Design Pat. Nos. 300,084 and 300,085 to Ito et al. and Des. 297,381 to Sugiyama. Other gel containing cushions for use in shoes are described in U.S. Pat. Nos. 5,155,927 and 5,493,792 to Bates et al. Shoes containing such gel filled cushioning elements are sold, for example, by ASICS Tiger Corporation, Fountain Valley, Calif. Such cushioning elements have not been used in headgear, particularly wrestling headgear.

OBJECTS AND SUMMARY OF THE INVENTION

It is an object of this invention to provide a novel headgear for wrestlers and the like that will protect their ears from injuries.

It is yet another object of this invention to provide headgear for wrestlers that has a unique cushioning element surrounding the ears to provide enhanced protection for the ears.

It is a further object of this invention to provide protective headgear which is relatively comfortable to wear during the athletic activity.

It is another object of this invention to provide protective headgear that is securely affixed to the wearer's head with a minimum of straps that are easily adjustable, but which do not provide an irritant or will not come out of adjustment during the athletic activity.

It is a further object of the present invention to provide protective headgear that is easily manufactured and competitively priced.

Still another object of this invention is to improve the gripping surface of the ear pad surrounding the ear during violent wrestling activities.

These and other objects and advantages are achieved by the improved protective headgear of this invention. The headgear includes a pair of ear guards. Each ear guard has a generally disk-like core having a peripheral edge portion, an interior surface and an exterior surface. Preferably, a pattern of vent openings is provided in the core that connect the interior and exterior surfaces. A layer of gel cushioning material, preferably silicon gel cushioning material covers the interior surface of the peripheral edge. Preferably, a one-piece removable ear guard covering of a tacky, flexible material covers each ear guard. The covering has a core portion of a continuous web that covers the exterior surface of the core, leaving the pattern of vent openings exposed. The covering also includes a peripheral edge portion that covers the exterior surface of the peripheral edge and the layer of gel cushioning material.

The headgear additionally has a plurality of circumferentially spaced loops associated with the peripheral edge portion of each ear guard and a plurality of head straps. Each head strap has one end secured to a loop on one ear guard and the other end adjustably secured to a corresponding loop on the other ear guard by releasable engagable hook and pile retainers on the head strap. Some of the straps may have both ends adjustably secured to corresponding loops by such hook and pile retainers.

With the above and other objects in view, the nature of the invention will be more clearly understood by reference to the following detailed description, the appended claimed subject matter, and the several views illustrated in the accompanying drawings.

DETAILED DESCRIPTION OF THE INVENTION

Figure 1:
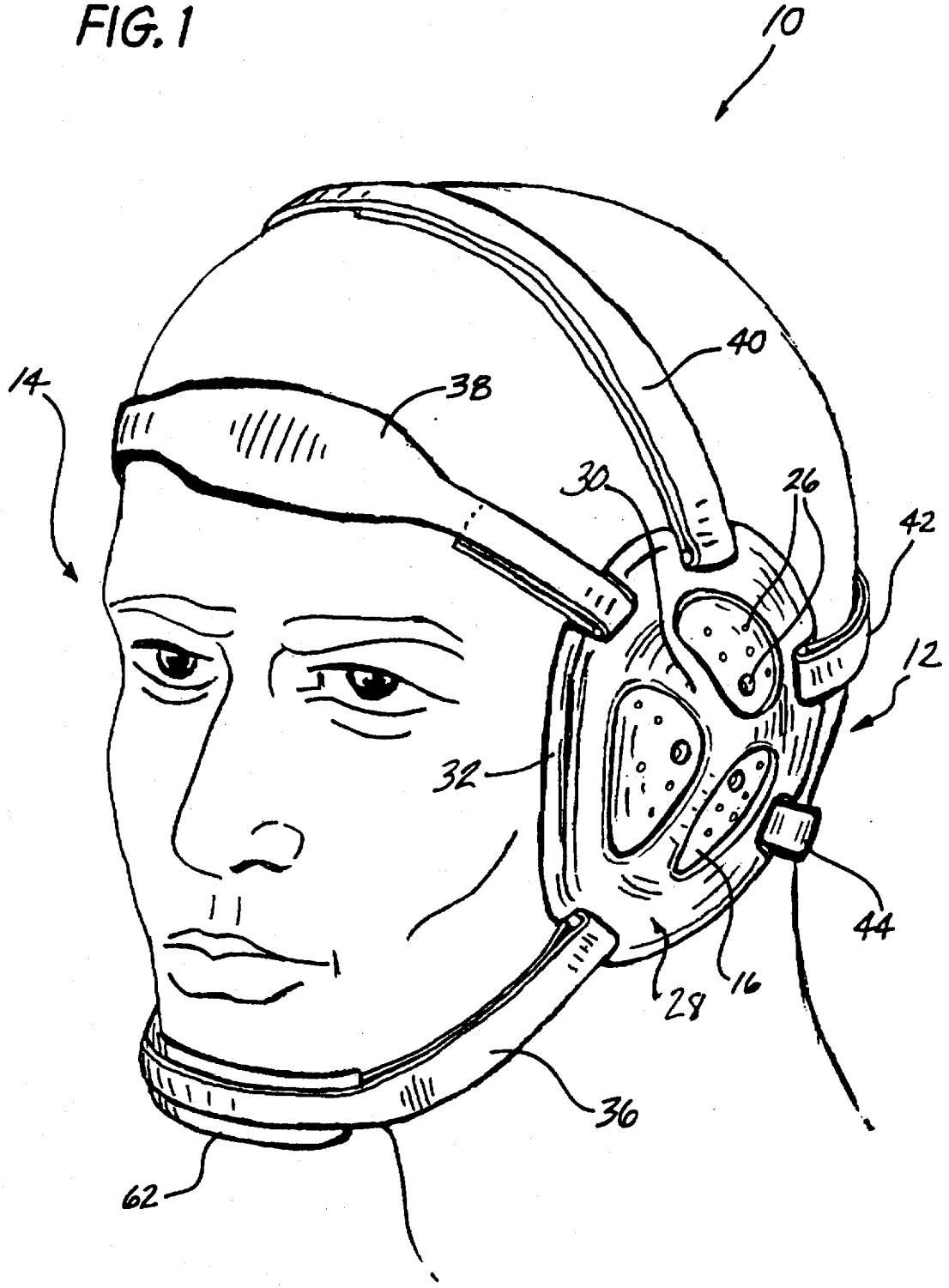
FIG. 1 is a perspective view of the wrestling headgear of this invention positioned on a wearer's head.
Figure 2:
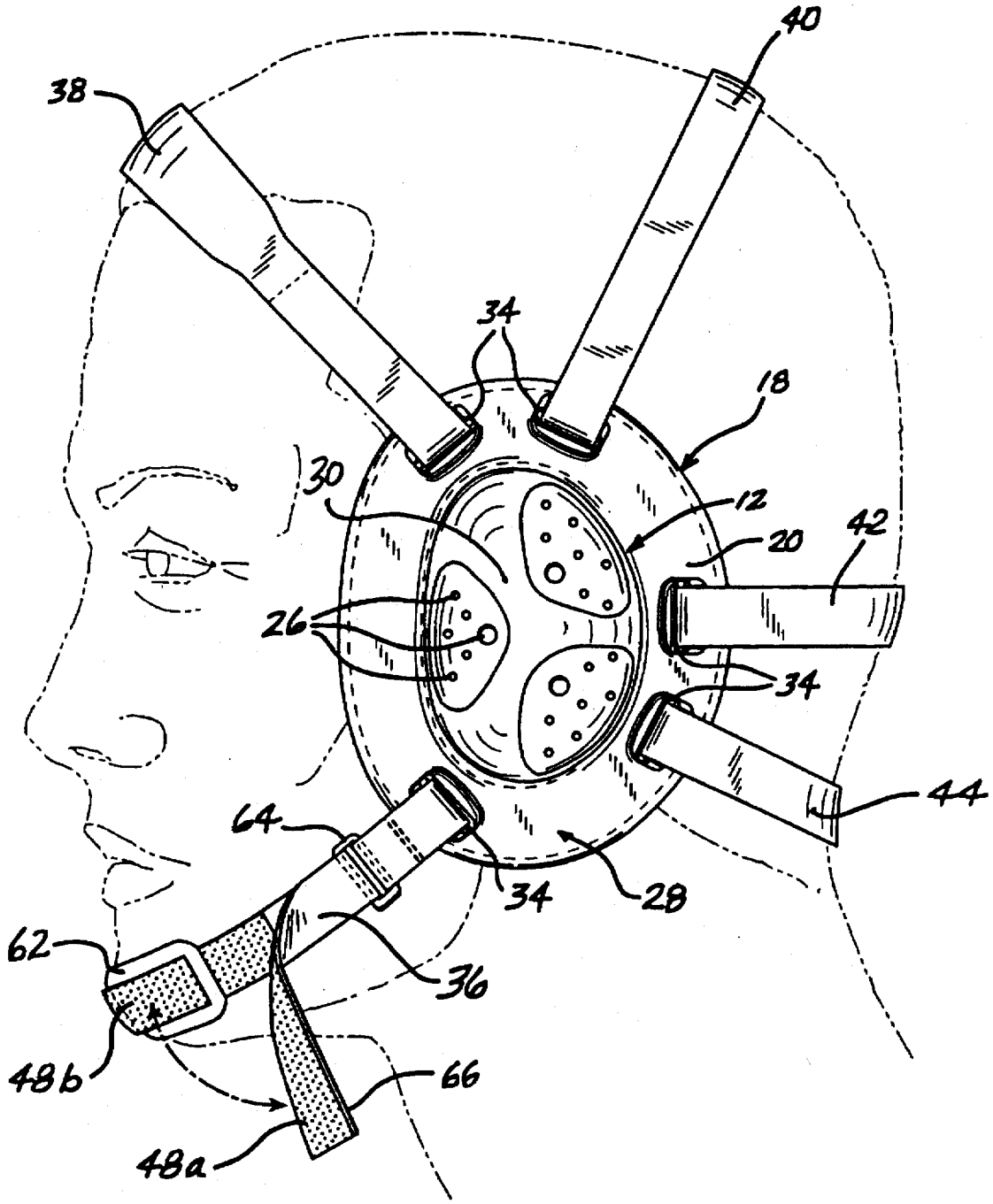
FIG. 2 is a side elevational view showing the wrestling headgear of this invention positioned upon a wearer's head.

A novel protective wrestling headgear constructed in accordance with this invention is fully illustrated in FIGS. 1–6 and is generally designated by the reference numeral 10. The headgear 10 includes a pair of ear guards 12,14 which are of identical construction.

The ear guard 12 includes a generally disk-like core 16 made of a plastic material which is of an arcuate configuration and terminates at a peripheral edge portion 18. The peripheral edge portion includes an exterior surface 20 and interior surface 22. See FIGS. 4 and 5, respectively. A layer of gel cushioning material 24, preferably silicon gel cushioning material covers the interior surface 22 of the peripheral edge portion 18 and is attached thereto by, for example, gluing. A secondary cushioning material 25 may underlie the gel cushioning material 24 to provide an enhanced cushioning effect. Such gel materials are well known for use in shoes, see, for example, U.S. Pat. No. 4,768,295 to Ito, U.S. Design Pat. Nos. 300,084 and 300,085 to Ito et al. and 297,381 to Sugiyama, and U.S. Pat. Nos. 5,155,927 and 5,493,792 to Bates et al., the entire disclosures of which are incorporated herein by reference. Such cushioning elements have not, however, been used in wrestling headgear.

A pattern of vent openings 26 is provided in the core 16. The vent openings 26 connect the interior and exterior surfaces of an ear guard 12,14 and permit the wearer to hear while preventing damage to the ear drum due to variations in pressure caused by the movement of the ear guard 12,14.

A one-piece removable, flexible ear guard covering 28, preferably made of a soft tacky polymeric material, covers each ear guard 12,14. The covering 28 has a core portion 30 of a continuous web that covers the exterior surface of the core 16, leaving the pattern of vent openings 26 exposed. The covering 28 also includes a peripheral edge portion 32 that covers the exterior surface of the peripheral edge 20 and the layer of gel cushioning material 24. The covering 28 has a relatively high coefficient of friction between the peripheral edge portion 32 and the skin surrounding the ear to thus provide an ear guard 12,14 that does not slip off as easily as known headgear. The covering 28 is removable to permit replacement thereof, due to tearing, wear, etc.

Figure 4:
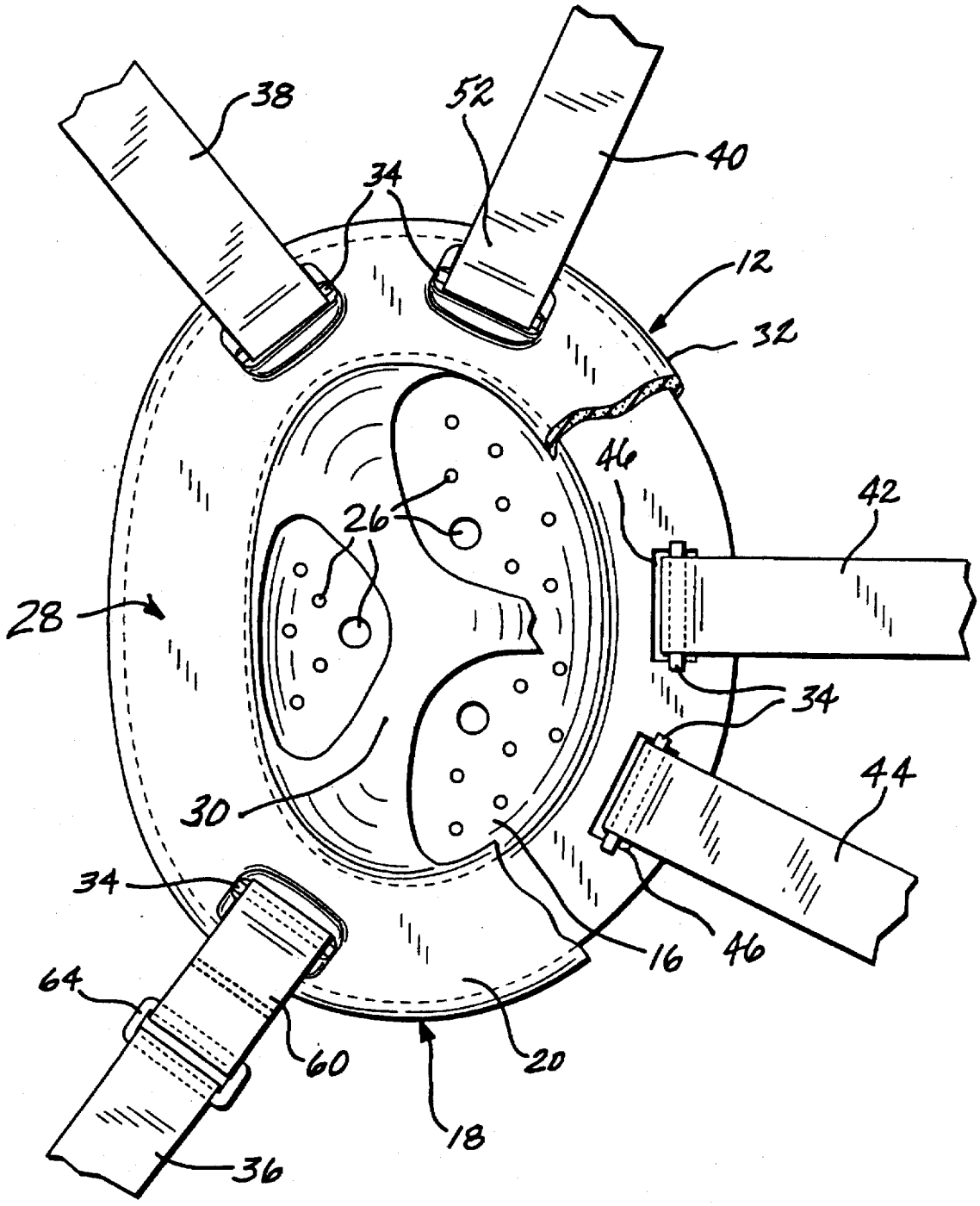
FIG. 4 is an enlarged, elevational view of the exterior of one of the protective ear guards with its straps taken along line 4—4 of FIG. 3.
Figure 5:
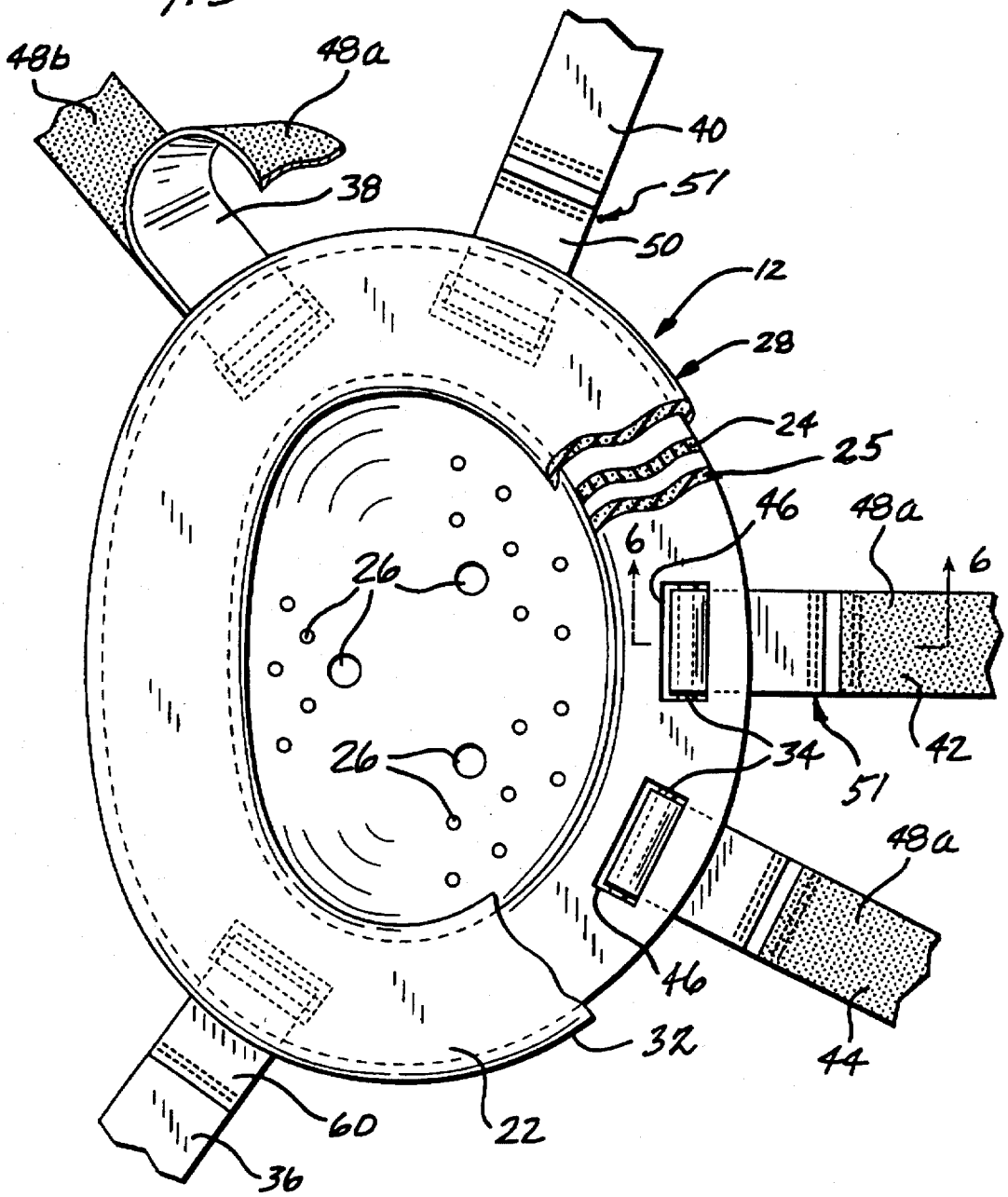
FIG. 5 is an enlarged, elevational view of the interior of one of the protective ear guards with its straps taken along line 5—5 of FIG. 3.
Figure 6:
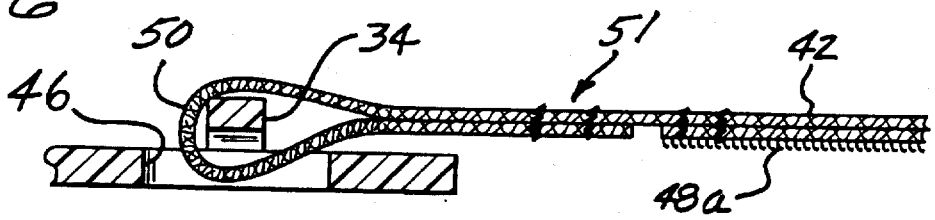
FIG. 6 is a cross-sectional view of the ear guard of FIG. 5 taken along line 6—6.

Referring to FIGS. 4, 5 and 6, each ear guard 12,14 has a plurality of circumferentially spaced loops 34 associated with the peripheral edge portion 18 of each ear guard and a plurality of head straps 36,38,40,42,44. The covering 28 is provided along its outer periphery 32 with a plurality of generally rectangular slots 46 which permit the loops 34 to pass therethrough to permit each of the head straps 36,38, 40,42,44 to be attached thereto.

Each head strap has one end secured to a loop 34 on one ear guard 12 and the other end adjustably secured to a corresponding loop 34 on the other ear guard 14 by releasable engageable hook 48*a* and pile 48*b* retainers on the head strap.

More specifically, referring to FIGS. 1–3 and 6, head straps 40,42,44 are generally identical to each other. Referring to head strap 40 as illustrative of each of these straps, the strap 40 is formed of a fabric material. One end 50 is received in an associated one of the loops 34 of the ear guard 12, folded upon itself and stitched 51 together, e.g., see FIG. 6. The opposite end portion 52 of the head strap 40 has thereon releasable engageable hook 48*a* and pile 48*b* retainers. This end portion 52 is passed through a corresponding loop 34, and folded upon itself to provide an adjustable, releasable engageable retainer.

Figure 3:
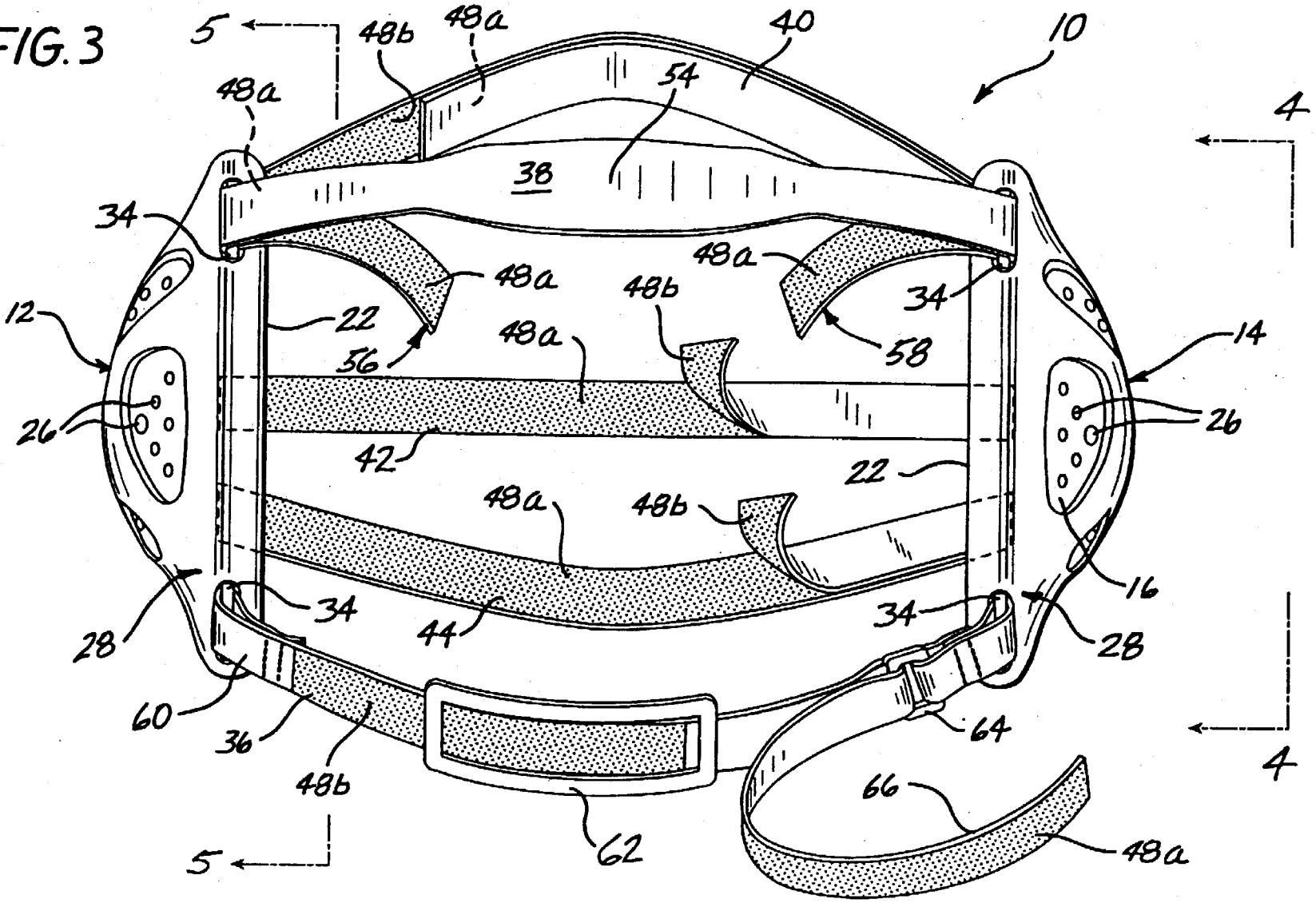
FIG. 3 is another perspective view of the wrestling headgear of this invention.

Referring to FIG. 3, generally forehead strap 38 is provided with an adjustable, releasable engageable retainer on each end of the strap 38 to permit the wider forehead center portion 54 of strap 38 to be centered on the forehead of the wrestler. More specifically, each end portion 56, 58 of the forehead strap 40 has thereon releasable engageable hook 48*a* and pile 48*b* retainers. The end portions 56, 58 are each passed through a corresponding loop 34, and folded upon itself to provide adjustable, releasable engageable retainers on each end portion 56,58.

Still referring to FIG. 3, the chin strap 36 has one end 60 that is received in an associated one of the loops 34 of the ear guard 12, folded upon itself and sewn together. Slidably, adjustably retained on strap 36 is a chin piece 62. Affixed to a corresponding loop 34 on the other ear guard 14 is a link 64. The opposite end portion 66 of the chin strap 36 has thereon releasable engageable hook 48*a* and pile 48*b* retainers. This end portion 66 is passed through the link 64 and folded upon itself to provide an adjustable, releasable engageable retainer.

The headgear of this invention provides enhanced protection for a wrestler's ears from injuries through the use of a unique cushioning element surrounding the ears and can be securely affixed to the head with a minimum of straps that are easily adjustable and will not come out of adjustment. The head gear further has an ear guard that has an improved gripping surface surrounding the ear, is relatively comfortable and is relatively inexpensive and easy to manufacture.

While preferred forms and arrangements of parts have been shown in illustrating the invention, it is to be clearly understood that various changes in details and arrangement of parts may be made without departing from the spirit and scope of the disclosure.

What is claimed is:

1. A protective wrestling headgear for use by a wrestler comprising:

a pair of ear guards each of which comprises:

a generally disk-like core having a peripheral edge portion, an interior surface and an exterior surface, a pattern of a plurality of vent openings in the core connecting interior and exterior surfaces;

a layer of gel impact cushioning material covering the interior surface of the peripheral edge portion;

a one-piece removable ear guard covering of a flexible material, the earguard covering comprising:

a covering core portion of a continuous web covering the exterior surface of the core of the earguard, the pattern of vent openings in the core of earguard being exposed, and a covering peripheral edge portion covering the exterior surface of the peripheral edge of the earguard and the layer of gel cushioning material, wherein the covering peripheral edge portion has a tacky exterior surface to grip the area surrounding wrestler's ear;

a plurality of circumferentially spaced loops associated with the peripheral edge portion of each ear guard, and a plurality of head straps, each head strap having one end secured to a loop on one ear guard and the other end adjustably secured to a corresponding loop on the other ear guard by releasably engageable hook and pile retainers on the head strap.

2. The wrestling headgear of claim 1, wherein the cushioning material is a silicon gel cushioning material.

3. The wrestling headgear of claim 1, wherein each head strap has two ends, the ends of each head strap being adjustably secured to corresponding loops on the earguards by releasably engageable hook and pile retainers on each head strap.

* * * * *